US006712075B1

(12) United States Patent
Garcia

(10) Patent No.: US 6,712,075 B1
(45) Date of Patent: Mar. 30, 2004

(54) SMOKING TIMER

(76) Inventor: Modesto J. Garcia, 3269 Clairmont Rd. NE., Atlanta, GA (US) 30329-1017

( * ) Notice: Subject to any disclaimer, the term of this patent is extended or adjusted under 35 U.S.C. 154(b) by 0 days.

(21) Appl. No.: 10/218,146

(22) Filed: Aug. 14, 2002

(51) Int. Cl.[7] ..... A24F 47/00
(52) U.S. Cl. ..... 131/270; 131/242; 206/242; 206/276; 206/265; 206/236; 206/268
(58) Field of Search ..... 131/270, 242; 206/242, 276, 265, 250, 236, 268

(56) References Cited

U.S. PATENT DOCUMENTS 2,649,753 A * 8/1953 Doye, Jr. ..... 116/133
4,076,118 A * 2/1978 Karlsson ..... 206/268
4,620,555 A * 11/1986 Schwarz ..... 131/270
4,862,431 A * 8/1989 Drouin ..... 368/10

FOREIGN PATENT DOCUMENTS

GB 2184870 * 7/1987 ..... 206/268

* cited by examiner

*Primary Examiner*—Dionne A. Walls
(74) *Attorney, Agent, or Firm*—Stephen J. Stark; Miller & Martin LLP

(57) ABSTRACT

What I believe is a totally new way to help the people addicted to smoking cigarettes to quit the habit by spacing the time between smokes and preventing the unconscious reach for one by means of a case or container for the cigarettes with a timing mechanism that will not open the container until a pre-determined time is reached. That timing mechanism can be reset from a few minutes to several hours therefore gradually reducing the absorption of nicotine until the craving for it is negligible and quitting the habit is easy.

1 Claim, 1 Drawing Sheet

SMOKING TIMER

BACKGROUND OF THE INVENTION

1. Field of the Invention

The present invention relates to ways of health maintenance procedures as blood pressure machines, diabetes detection devices and others 2. Description of Related Art There are methods to help patients take the medications prescribed by a doctor including a container to put the medications in an a timer to have an audible or vibrating signal to tell the patient that it is the time to swallow, inhale or inject the medications.

SUMMARY OF THE INVENTION

The present invention is a new way to help smokers quit the habit without the need for patches, chewing gum, hypnotism, or quitting "cold turkey". I consists of a container to put the cigarettes in and such container will have a timing mechanism that the user can set the interval of time when he or she can get a cigarette. This timer will not have an audible vibrating or any other kind of signal.

DETAIL DESCRIPTION OF THE PREFERRED EMBODIMENTS

Reference will now be made in detail to the preferred embodiments of the invention, one example of which is illustrated in the accompanied drawings.

This example is provided by way of explanation of the invention, not for limitation of the invention. In fact, it will be apparent to those skilled in the art, that. Modifications and variations can be made to the present invention without departing from the scope or spirit thereof.

The present invention is concerned with helping those with the smoking habit to overcome the need for nicotine and also to prevent the unconscious reach for a cigarette. To do this the addicted person wilt keep their cigarettes in a container that has a locking mechanism, and that locking mechanism will unlock only at a pre-determined time.

Figure 1:
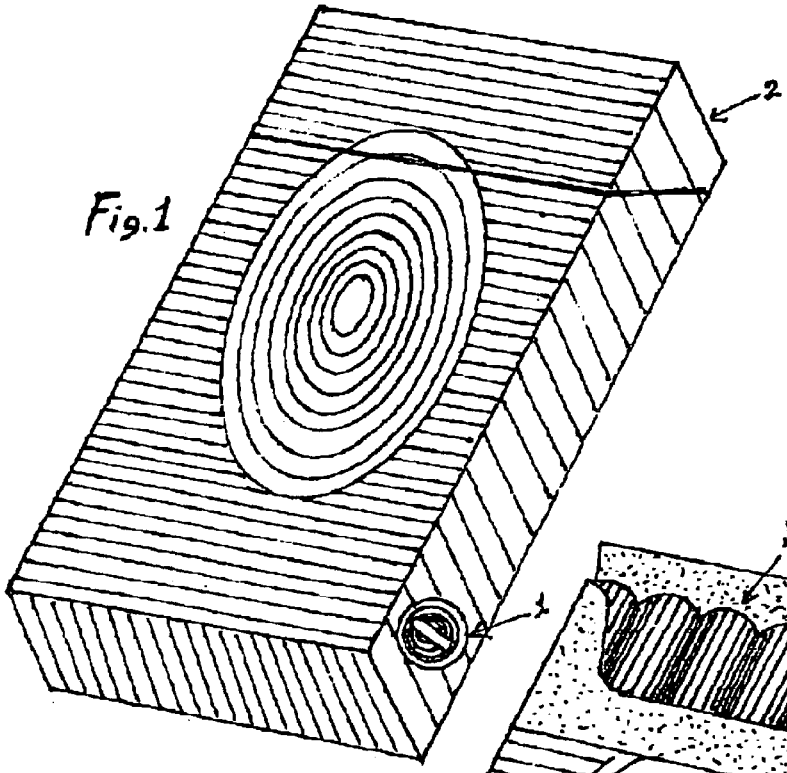
FIG. 1—Shows the container when it is closed.

Accordingly with all the above 1 will try to explain how the invention works. FIG. 1—Shows a container for cigarettes and on one side of it there is a cap 1 to insert and secure a battery that wilt provide the electric power to operate the mechanism and 2 is the top or cover of the container, secured to to box by a hinge on the back of it (not illustrated) to permit the opening and closing to access the cigarettes.

Figure 2:
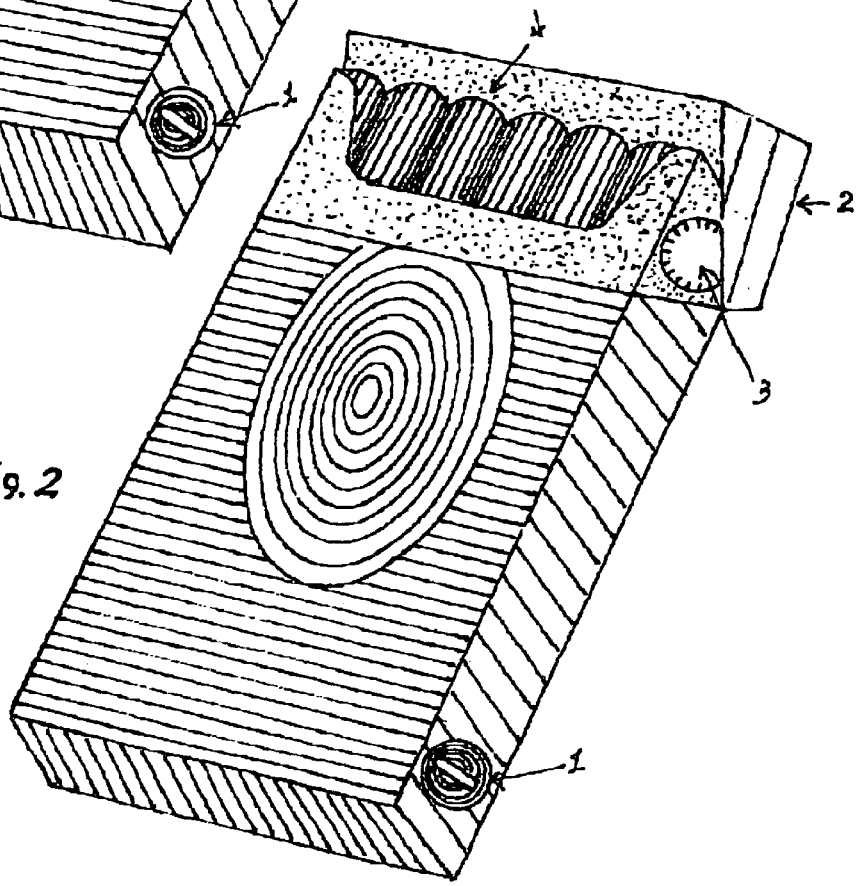
FIG. 2—Shows the container when it is open.

FIG. 2—Shows the container when the top 2 is open. At this time the smokers will put in their cigarettes 4 and set the timer 3 at the desired rate. Lets assume that a person is smoking three packs of cigarettes a day and is awake 16 hours a day. That will be one cigarette every 16 minutes, or less because of the unconscious motion of reaching for a cigarette. To begin, the timer should be set for 20 minutes.

If the addict reaches for a cigarette before time will find that the cover is locked and has to wait. When the 20 minutes are over the latch opens, but the mechanism will not alert the smoker that he or she can get a cigarette.

When finally they open the container a get the cigarette and closes the lid, the cycle will start again. Whenever they ate ready to improve and while the lid is open the timer can be reset for 25 or 30 minutes and so on and on until the tier is set for 12 hours and that will be one cigarette when they get up in the mornimg and another at bed time. 2 cigarettes a day. At that point it will be very easy to quit.

What is claimed is:

1. A container for cigarettes comprising:

a box member having an open top at an upper end, a front, a back, a bottom, and opposing sides, said front of said box having a cutout extending from the upper end, said sides sized to extend a length as long as a standard cigarette, said box member having a cigarette chamber therein;

a cover having sides, a top, a back and a front, said front of said cover having a length at least twice as long as a length of the back of the cover;

a hinge connecting a lower end of the back of the cover to the back of the box member at the upper end of the back of the box;

said cover having a closed configuration in which the top of the cover is substantially parallel to the bottom of the box member, when in said closed configuration the sides of the cover respectively extend over portions of the sides of the box member and the front of the cover extends over a portion of the front of the box member obscuring the cutout from view and resulting in the sides of the cover being coplanar with the respective sides of the box member and the front of the cover being coplanar with the front of the box member, said cover having an open configuration wherein the cover is rotated about the hinge relative to the box member exposing the cigarette chamber for accessing cigarettes when located therein;

a timer, said timer having an adjustment mechanism disposed toward the upper end of the box member on one of the sides wherein said timer is obscured from view when the cover is in the closed configuration, said adjustment mechanism providing an ability to set a predetermined time, said timer triggered to initiate by the replacement of the cover in the closed configuration;

a locking member configured to lock the cover in a locked configuration upon replacement in a closed configuration relative to the box member, said locking member coupled to the timer wherein upon an expiration of the predetermined time, said timer provides a signal to the locking member thereby unlocking the cover relative to the box member while maintaining the cover in a closed configuration; and wherein when said cover is in the locked configuration, the locking member prevents the cover from being able to be rotated about the hinge relative to the box member to the open configuration.

* * * * *